US008590730B2

(12) United States Patent
Buck

(10) Patent No.: US 8,590,730 B2
(45) Date of Patent: Nov. 26, 2013

(54) TOP MOUNTING CAN CONTAINER

(76) Inventor: Ronald Mark Buck, Encinitas, CA (US)

( * ) Notice: Subject to any disclaimer, the term of this patent is extended or adjusted under 35 U.S.C. 154(b) by 0 days.

(21) Appl. No.: 13/437,911

(22) Filed: Apr. 2, 2012

(65) Prior Publication Data

US 2013/0056476 A1 Mar. 7, 2013

Related U.S. Application Data

(63) Continuation of application No. 13/303,080, filed on Nov. 22, 2011, which is a continuation-in-part of application No. 13/226,346, filed on Sep. 6, 2011.

(51) Int. Cl.
*B65D 41/18* (2006.01)
*A47G 19/22* (2006.01)

(52) U.S. Cl.
USPC ..... 220/709; 220/786; 220/784; 220/495.03; 220/729; 220/23.83

(58) Field of Classification Search
USPC ..... 220/326, 784, 786, 705, 709, 906, 23.4, 220/212, 669, 670, 793, 495.03, 729
See application file for complete search history.

(56) References Cited

U.S. PATENT DOCUMENTS

| | | | | |
|---|---|---|---|---|
| 1,665,289 | A | 4/1928 | Weaver | |
| 3,288,344 | A | 11/1966 | Woollen | |
| 3,323,706 | A | 6/1967 | Gereke | |
| 3,413,128 | A | 11/1968 | Steinbarth et al. | |
| 3,421,654 | A * | 1/1969 | Friedrich | 220/254.3 |
| 3,616,897 | A | 11/1971 | Vrana | |
| 3,679,089 | A | 7/1972 | Swett et al. | |
| 3,817,419 | A * | 6/1974 | Moller et al. | 220/315 |
| 4,054,205 | A | 10/1977 | Blow, Jr. et al. | |
| 4,074,827 | A | 2/1978 | Labe, III | |
| 4,091,953 | A | 5/1978 | Daenen | |
| 4,627,537 | A | 12/1986 | Rogers | |
| 5,145,646 | A | 9/1992 | Tyranski | |
| 5,180,079 | A | 1/1993 | Jeng | |
| 5,283,140 | A | 2/1994 | Netz et al. | |
| 5,310,072 | A | 5/1994 | Matusovsky et al. | |

(Continued)

FOREIGN PATENT DOCUMENTS

| | | |
|---|---|---|
| EP | 1397986 | 3/2004 |

OTHER PUBLICATIONS

International Search Report Dated Mar. 19, 2013, 14 pages.

*Primary Examiner* — Anthony Stashick
*Assistant Examiner* — James N Smalley
(74) *Attorney, Agent, or Firm* — ARC IP Law, PC; Joseph J. Mayo

(57) ABSTRACT

Top mounting can container that couples with a can. One or more embodiment enables simultaneous access to both the contents of the can and contents of the container. A half circle cut-out in the lid provides for spill free snacking from an independent vessel. Various configurations enable the inclusion of fresh food, eating and drinking from a straw if desired while standing and walking and access of solid or liquid in the container and can. Coupling elements that couple the top mounting can container to the can, may utilize any type of easily removable or semi-removable technology. Simplifies eating and drinking from one container and can in a theater or stadium having seats for example that provide one beverage holder per seat. Provides one free hand to hold a child's hand for safety while in stadiums and amusement parks.

19 Claims, 11 Drawing Sheets

(56) References Cited

U.S. PATENT DOCUMENTS

| | | | | |
|---|---|---|---|---|
| 5,318,787 | A | 6/1994 | Brauner | |
| 5,402,903 | A * | 4/1995 | Mann | 220/23.6 |
| 5,503,858 | A | 4/1996 | Reskow | |
| 5,573,131 | A | 11/1996 | Berjis | |
| 5,624,053 | A | 4/1997 | Freek et al. | |
| 5,720,555 | A | 2/1998 | Elele | |
| 5,743,423 | A | 4/1998 | Franco | |
| D397,911 | S | 9/1998 | Waldmann | |
| 5,954,195 | A | 9/1999 | Krueger et al. | |
| 6,003,671 | A | 12/1999 | McDonough et al. | |
| 6,079,587 | A | 6/2000 | Vogt | |
| 6,085,919 | A | 7/2000 | Singer | |
| 6,119,884 | A * | 9/2000 | Lowry | 220/62.13 |
| 6,164,485 | A | 12/2000 | Hilton | |
| 6,209,748 | B1 | 4/2001 | Dunbar | |
| 6,299,014 | B1 | 10/2001 | Nava et al. | |
| 6,314,866 | B1 | 11/2001 | Melton | |
| 6,338,417 | B1 * | 1/2002 | Ferraro | 220/23.83 |
| 6,412,526 | B2 | 7/2002 | Castillo | |
| 6,425,480 | B1 | 7/2002 | Krueger et al. | |
| 6,427,864 | B1 | 8/2002 | Asselin | |
| 6,528,105 | B1 | 3/2003 | Gerhart et al. | |
| 6,557,698 | B2 | 5/2003 | Gordon | |
| 6,641,854 | B2 | 11/2003 | Gerhart | |
| 6,706,297 | B1 | 3/2004 | Toth et al. | |
| 6,708,735 | B1 | 3/2004 | Kenihan | |
| 6,793,075 | B1 | 9/2004 | Jeter | |
| 6,932,231 | B2 | 8/2005 | Haynes | |
| 7,063,229 | B2 | 6/2006 | Westerhof et al. | |
| 7,111,748 | B2 | 9/2006 | Cha | |
| 7,159,732 | B2 | 1/2007 | Smith et al. | |
| 7,217,434 | B1 | 5/2007 | Loh et al. | |
| 7,387,063 | B2 | 6/2008 | Vu et al. | |
| D590,662 | S | 4/2009 | Cheng | |
| 7,588,275 | B2 * | 9/2009 | Borg | 294/87.2 |
| 7,594,584 | B2 | 9/2009 | Durdon et al. | |
| 7,721,911 | B2 | 5/2010 | Chou | |
| D635,855 | S | 4/2011 | Smith et al. | |
| D637,079 | S | 5/2011 | Brown et al. | |
| 8,006,854 | B2 | 8/2011 | Waugh | |
| 2001/0035417 | A1 | 11/2001 | Kantor | |
| 2003/0089714 | A1 | 5/2003 | Dart et al. | |
| 2004/0050724 | A1 * | 3/2004 | Grul et al. | 206/217 |
| 2004/0050847 | A1 | 3/2004 | Yoon | |
| 2004/0084452 | A1 | 5/2004 | Hsieh | |
| 2004/0089662 | A1 | 5/2004 | Smith et al. | |
| 2004/0149755 | A1 | 8/2004 | Olivar | |
| 2004/0182862 | A1 | 9/2004 | Scott | |
| 2005/0035011 | A1 | 2/2005 | McRobbie | |
| 2005/0115845 | A1 | 6/2005 | Cho | |
| 2005/0178677 | A1 | 8/2005 | Morrow | |
| 2005/0178688 | A1 | 8/2005 | Hasson | |
| 2005/0199639 | A1 * | 9/2005 | Tucker et al. | 220/780 |
| 2005/0205437 | A1 | 9/2005 | Huffman et al. | |
| 2005/0269328 | A1 * | 12/2005 | Crider et al. | 220/276 |
| 2006/0060589 | A1 | 3/2006 | Lee | |
| 2006/0096983 | A1 | 5/2006 | Patterson | |
| 2007/0029322 | A1 | 2/2007 | Durdon et al. | |
| 2007/0278122 | A1 | 12/2007 | McCumber | |
| 2008/0023503 | A1 | 1/2008 | Freeman | |
| 2008/0099481 | A1 | 5/2008 | D'Amato | |
| 2008/0230541 | A1 | 9/2008 | Bayss et al. | |
| 2009/0065377 | A1 | 3/2009 | Olomi et al. | |
| 2009/0206089 | A1 | 8/2009 | Mueller | |
| 2009/0250479 | A1 | 10/2009 | Kaufman et al. | |
| 2009/0272390 | A1 * | 11/2009 | Blondeel | 131/231 |
| 2011/0114643 | A1 | 5/2011 | Bogdziewicz | |
| 2011/0168719 | A1 | 7/2011 | Lotterhos | |
| 2011/0198351 | A1 | 8/2011 | D'Amato | |
| 2011/0198355 | A1 | 8/2011 | Mullen | |
| 2011/0210126 | A1 | 9/2011 | Vovan | |
| 2011/0248033 | A1 | 10/2011 | Mehrvijeh | |
| 2011/0266295 | A1 | 11/2011 | Yacktman | |
| 2011/0284537 | A1 | 11/2011 | Cerasani | |

* cited by examiner

FIGURE 7A
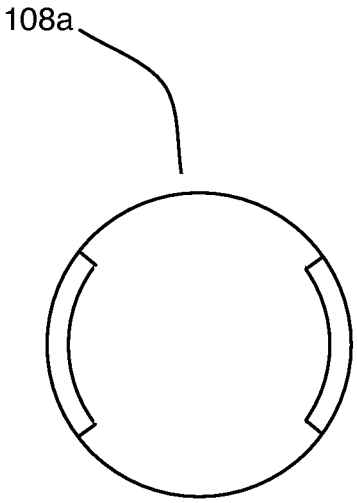
FIGURE 7B
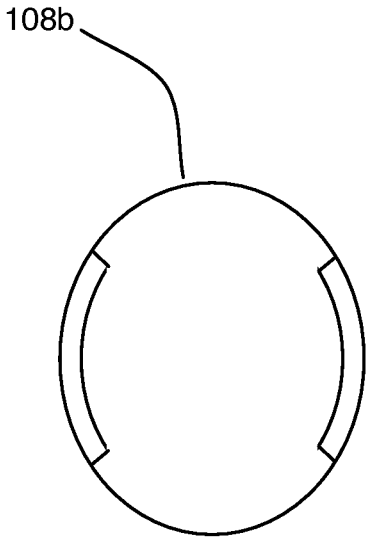
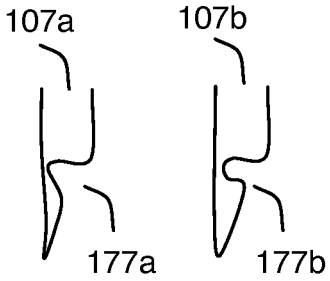
FIGURE 7C

TOP MOUNTING CAN CONTAINER

This application is a continuation of U.S. Utility patent application Ser. No. 13/303,080 filed 22 Nov. 2011, which is a continuation-in-part of U.S. Utility patent application Ser. No. 13/226,346 filed 6 Sep. 2011, the specifications of which are hereby incorporated herein by reference.

BACKGROUND OF THE INVENTION

1. Field of the Invention

One or more embodiments of the invention are related to the field of containers. More particularly, but not by way of limitation, one or more embodiments of the invention provides for a top mounting can container that enables for example one handed carrying of the can and container and/or simultaneous access, through a straw if desired, of the contents of the can and container after momentarily removing and reattaching the top mounting container to the can. An alternative configuration is where the container is removed from the can and utilized as a separate unit or vessel. When a pull tab removes a piece of the lid in a half-circle shape along a score line a system is provided whereby snacks may be selectively lifted and shaken into the mouth without the worry of spilling additional contents from the container. In effect a spill-free container is created. The independent vessel may be reattached to the can when desired.

2. Description of the Related Art

Cans generally include an inner chamber but do not include an integrated upper container to hold other food items for example. There are no known containers that couple with cans. When carrying a can, it is cumbersome to also carry a container with food in the same hand. It is generally not possible to access the contents of the can while also accessing the contents of an additional container while holding both in one hand, in other words, under normal circumstances one hand is required to access the contents of the can and another hand is generally required to access the contents of a container.

Known containers that couple with cups include food containers that fit onto the top of yogurt cups for example. Known containers have to be removed from the yogurt cup and then flipped over and opened before the contents of the container and cup may be accessed. Once flipped and opened such containers cannot couple while in the upright position to the yogurt cup, and additionally such containers cannot couple with a can.

Known containers that couple with bottles include gift containers that fit onto the top of bottles for example. It is generally not possible to access the contents of the bottles while also accessing the contents of the gift container.

Thus simultaneous access of the contents of cans, cups or bottles and the contents of a container is not possible while holding both in one hand. This makes for difficult drinking/eating canned liquids, such as tea, soda, beer, etc., and snacks, such as cookies, crackers, etc., in malls, public zoos, theaters, amusement parks, sports stadiums or in any other venue. For example, it is difficult to drink and eat while standing and walking to a desired location, normally it is necessary to stop and sit to use two hands to eat and drink.

Known objects that couple with the top of a can include "COMBINATION MULTIPLE-CANNISTER CARRIER AND LIP PROTECTION DEVICE" as described in U.S. Pat. No. 7,588,275 to Borg. A planar ring with downward pointing flanges is described that allows for multiple cans to be carried together as a unit. The problem with the device is that it does not enable a container, for example filled with food to couple to the top of the device and hence, two hands are required to carry the cans held by the device and a container, for example with food. In addition, there is no contemplation of accessing the contents of the can while the device is coupled to the can. There is no contemplation of thermochromic materials to show the temperature of any associated portion of the can or device.

For at least the limitations described above there is a need for a top mounting can container.

BRIEF SUMMARY OF THE INVENTION

One or more embodiments described in the specification are related to a top mounting can container. Embodiments of the invention generally provide a cavity, compartment or closed space, wherein the apparatus is configured to couple with the top of a can. One or more embodiments may include volumes that extend upward from the plane defined by the circular top of the can. In this manner, the can and container form at least two or more containment volumes, one volume formed by the can itself, and another volume within the container itself. A cover may be included that encloses the container. The cover or lid may be flat or alternatively indented with a circular ring to receive the bottom of a can when a can is stacked on top of the container. Various embodiments of the invention allow for quick and easy alignment and attachment and detachment of the container to the can. A replaceable lid allows for the inclusion of fresh foods. Additionally, it is possible to drink and eat from one hand while standing and walking Therefore, simultaneous access is provided for the liquid in the can and the solid in the container. An easily removable independent unit or vessel facilitates lift and shake style spill-free snacking One or more embodiments enable utilization of known attachment devices as disclosed for example in U.S. Pat. No. 7,588,275 to Borg, the specification of which is hereby incorporated herein by reference. Other embodiments of the invention may utilize improved versions of the Borg device as is described further below.

Embodiments of the invention may be made to fit any size of can, for example a beer or soda can, soup or canned food and may be quickly attached and removed and reattached to the can. Embodiments may be constructed from vacuum, thermal, injection, or blow molding techniques or in any other manner as desired. Any type of material may be utilized in the construction of one or more embodiments of the invention, for example plastic or polymer. One such plastic may be clear or opaque or any level of translucency. Materials may be chosen for strength and function as required. Common polymers or thermosetting polymers may include epoxy and phenolic materials. Thermoplastic materials that may be utilized include nylon, polyethylene, HDPE and polypropylene for example. A thin metal or aluminum foil may be used alone or as part of a layered construction for the lid or cover of the container. Any colors or color combinations may be used. One or more embodiments may utilize components of different translucent values, for example a bottom compartment of the container may be clear so the contents may be viewed without opening the container, while the peel-off or press-on lid portion of the container may be opaque to provide a solid background for printing corporate names, logos or promotions. Embodiments of the invention may be made from recyclable materials or biodegradable materials as well. One or more embodiments of the invention may utilize sidewall ribs or thicker walls to increase strength depending on the desired implementation. Tapered wall construction enables stackable containers when empty, which is helpful for conserving space during transportation. The container may contain a single volume or may include a divider or multiple dividers within the cavity in order to keep food items separate, for example of different types of foods. Other embodiments of the invention may be utilized in combination with existing six-pack plastic ring holders as well.

The container cavity may contain a thermal liner, for example Styrofoam for cold items such as ice cream, to enable the creation of a "float" for example, or alternatively for hot items such as french fries. Additionally, the container cavity may contain a paper liner to absorb grease while also preventing hot foods from coming into direct contact with plastic that may potentially melt. The cavity may include a single or double wall for extra insulative effect or for any other reason. Thermal sensitive plastics, for example thermochromics may also be utilized to show how hot or cold the item in the container is. These types of plastics change color for example based on their temperature. Graphic symbols and/or letters that for example read "Caution Contents Hot", may be displayed for example when the thermochromic is hot, for example in Red, wherein the letters would not be shown otherwise, or would be shown in Blue for example if the contents of the container were not hot. These colors are exemplary and any color including transparent may be chosen to represent hot and cold in any embodiment of the invention. For embodiments that do not utilize thermochromic materials, any graphical symbols or lettering may be utilized to warn or inform a potential user. Graphical symbols and/or lettering may be placed on the top, sides, or inside of the container or in any other area that may be viewed or touched. Graphical symbols and/or lettering may include logos, advertisements, puzzles, promotions, trivia or any other type of information that is viewable and may include tactile information including Braille.

The vertical dimension of the cavity may vary from a low, for example about a half an inch when the container is configured to hold a cookie, to a medium, for example about one and a half inches when the container is configured to hold crackers or a doughnut or high, for example up to or more than four inches when the container is configured to hold ice cream or french fries. As one skilled in the art will appreciate, any desired dimension of the container may be utilized as desired for the particular application. The outer horizontal dimension of the container may be of a width less than, equal to, or greater than the diameter of the outside dimension of the can. However the preferred embodiment is when the container diameter is equal to the horizontal diameter of the outside of the can. Strength ribs may be utilized in one or more embodiments of the invention to increase the stackable strength of the container. These ribs may include vertically thicker beams on the inside or outside of the container, or alternatively or in combination, may also make use of thicker walls on the container to increase strength. As specified herein, a larger food volume capacity may be provided in the case of right side up containers as compared to upside down containers. This becomes evident when looking at right side up and upside down containers that attach to the same horizontal diameter on the top of the cup or can. Upside down containers are those for example which clip on to the top of yogurt cups that start in an upside down position and then must be removed and flipped over in order to access the contents of the container. Upside down containers have a limited food volume capacity due to the fact that they utilize vertical sidewalls that slant inward (necessary for stacking containers) as they proceed upward toward the bottom of the container (when placed upside down on a yogurt cup). Right side up containers do not need to be flipped to access the contents and have vertical sidewalls that slant outward as they proceed upward toward the rim of the container. The inwardly slanting vertical sidewalls of upside down containers limit the food volume capacity of the top container, while the outwardly slanting vertical sidewalls of right side up containers provide for increased food volume capacity of the top container.

Embodiments may be constructed from one or more parts. In one or more embodiments, two elements may be fused together utilizing heat and compatible materials, hot melt glues, hook and loop fasteners with adhesive backing, or adhesive layers, for example, or molded to utilize two separate units that clip or lock together, or in any other manner. Alternatively, embodiments of the invention may be formed or molded in any manner as a single unit. The shape of the container may be of any type, circular, oval, triangular, square or a polygon of any number of sides, or any other shape. One or more embodiments of the invention may include an oval coupling device that allows for disengagement of the oval embodiment by squeezing the wider portion, which decouples hooks from the rim of the can.

One or more embodiments of the invention may utilize any other type of coupling element as one skilled in the art will appreciate.

One or more embodiments of the invention may employ a hole such as a sip hole or straw hole or channel or tunnel for example, so that liquid in the can may be accessed from the can after momentarily removing and reattaching the container. Any shape of hole or any shape straw, i.e., oblong from a cross-sectional view, for any purpose may be utilized as desired. Embodiments employing a hole may make use of a hole at the base of the container adjacent to the outer perimeter of the top of the can, on a vertical wall of the container or as a diagonal tunnel that cuts into the bottom outside corner edge of the container. Such diagonal straw tunnel may occur from one to four times, while the preferred embodiment is one time. Embodiments employing a straw hole through the vertical wall of the bottom portion of the container employ a inwardly protruding stop-ridge for intercepting the top edge of the can. The stop-ridge is configured in four sections as the ridge is intersected by four straw holes. The stop-ridge may be one continuous ring or have any number of segments. The four inwardly protruding stop-ridges intercept the top edge of the can while the four clip-ridge segments at the lower edge of the container intercept the bottom edge of the can rim. Once the container is locked in place between these ridges, a vertical gap-space area is created directly above the stop-ridges and bottom of the container. The space-gap area provides a location for a promotional item or disc and a space where the straw can reside as it exits through the vertical sidewall of the container.

Although the top container may be heat fused to the bottom can mount element, or made from a single molded or thermal-formed unit, for example, an additional configuration is where the top portion of the container utilizes a clip-on system in the bottom horizontal wall or outer edge vertical wall area to attach to the bottom can mount element that contains the straw hole in the vertical wall. Such clip systems as mentioned here provide for removal and reattachment of the top container to bottom container portion, as desired by the user.

Embodiments of the invention may utilize a lid to cover the container. To avoid confusion, "cover" as utilized herein refers to the lid for the container. Embodiments of covers include seal/peel-off, press-on, i.e., external/internal wall friction, press-on dome, or hinged clam shell types of covers. Seal/peel-off covers may be configured using a thermal bonding process involving adhesives or similar or compatible materials, or may utilize adhesive that allows the cover to be removed permanently or temporarily depending on the adhesive, to access the cavity. The seal-peal cover may be comprised of several laminated layers of various materials and may include a thin metal or aluminum foil layer as part of a thermal or heat bonding process. Press-on covers are generally plastic covers that may be removed and placed back on the cavity, for example, when placing fresh foods such as cookies within the cavity, or if the contents of the container have not all been removed. Seal/peel-off and press-on covers may be utilized in combination, so that after the press-on cover and seal/peel-off covers are removed, exposing the contents of the container, then the press-on cover may be placed over the container again to enclose the contents of the container for example. Press-on dome covers for example may also include a hole on top that enables a spoon to access food within the container, such as frozen yogurt. Press-on external/internal wall friction covers may engage or couple in any manner that utilizes friction for the coupling. Press-on type covers may be implemented with a flat portion that is hinged at any peripheral location of the container that allows the lid to flex open in a clamshell fashion, exposing the contents of the container, while retaining the cover such that it remains attached to the exterior wall of the container. Covers may be flat or indented to receive the bottom of a can when stacking is involved. The tab may be a separate piece of plastic that utilizes adhesive or heat to bond around all edges of a hole that is cut completely through the lid or cover. Tabs may be flat, bent, thin and may utilize score lines and/or half circle cut-outs or any combination thereof with any shape of tab. Tabs may be secured to the lid through various methods of attachment as one skilled in the art will recognize.

Items suitable for placement within the container include solids or liquids. For example, items may include any combination of one or more solid and/or liquid alone or in combination. Example items include one or more cookie, doughnuts, chocolates, chips, crackers, nuts, popcorn, candies, ice cream, frozen ice, frozen yogurt, fruit pieces, french fries, or any other solid or liquid. Items that may be sealed in and stored for use or purchase may be refrigerated after sealing if necessary, or items that are selectively prepared or fresh can be placed into the container and may utilize the press-on cover embodiment if desired based on the particular application.

Embodiments of the invention allow for one-handed transportation and simultaneous access of the contents of the container and can after momentarily removing and reattaching the container to the can. Although, as specified here within, a clip-on system of engagement of the upper container to the bottom can mount element may be utilized, which allows the user to remove or reattach the container as a separate vessel from the can mount element as desired. Various embodiments allow for ease of carrying and drinking/eating coffee, soda, cookies, snacks, etc., in malls, public zoos, amusement parks, sports stadiums or in any other venue. For example, this allows a parent in an amusement park to carry food and beverages at the same time with one hand, while providing one hand free to hold the hand of a child for safety. In addition, embodiments of the invention simplify eating and drinking by combining these processes into one container and can, which is significantly more convenient in amusement parks or stadiums having seats, for example, which provide a single beverage holder per seat.

BRIEF DESCRIPTION OF THE DRAWINGS

The above and other aspects, features and advantages of the invention will be more apparent from the following more particular description thereof, presented in conjunction with the following drawings wherein:

FIG. 4A illustrates a perspective exploded view of various embodiments of the invention having one-part or two-part construction, while

DETAILED DESCRIPTION OF THE INVENTION

A top mounting can container will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1A:
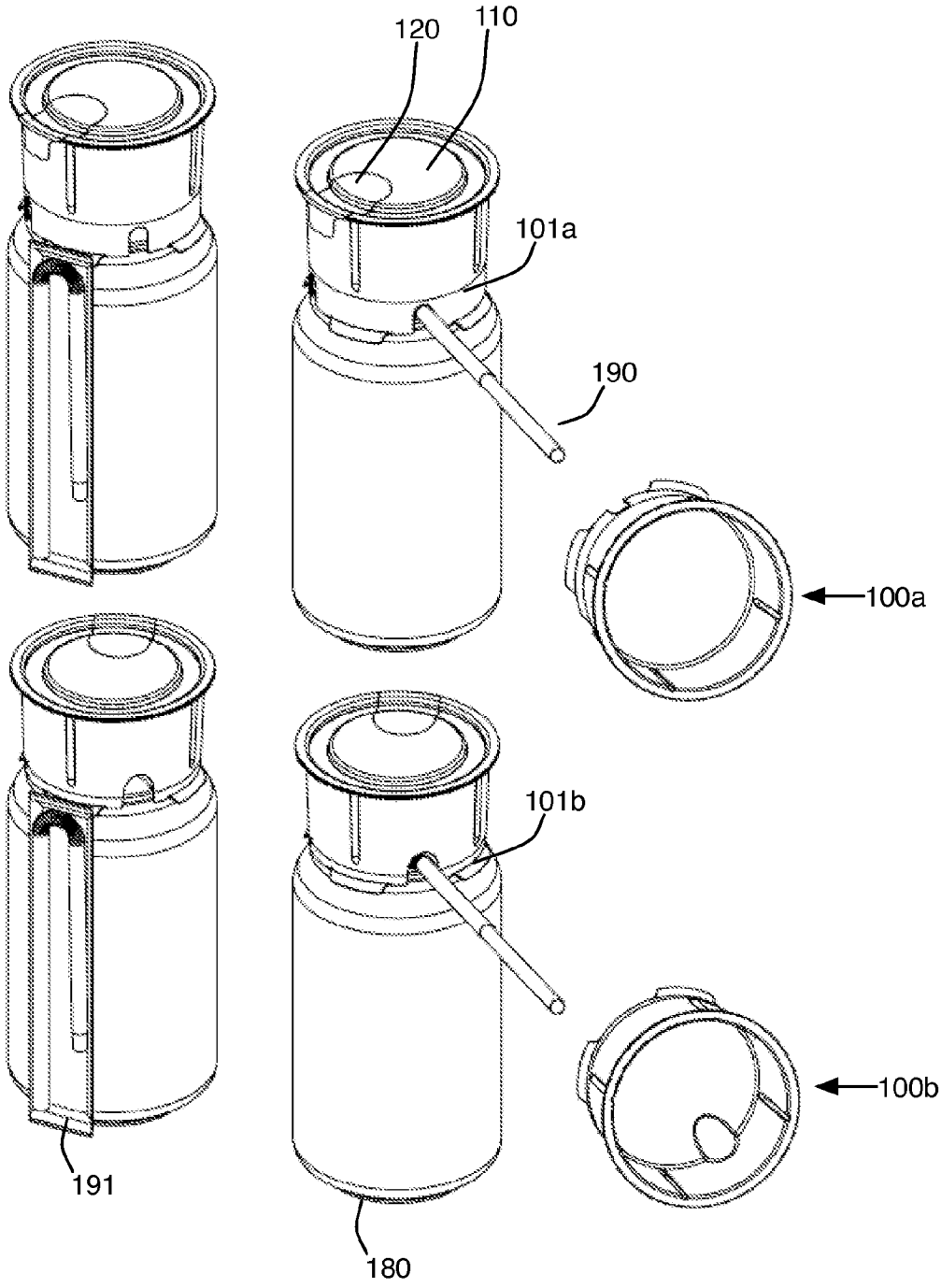
FIG. 1A illustrates a perspective view of two embodiments of the top mounting can container coupled with a can along with a straw and cover, wherein the container has been momentarily removed and reattached to the can in order to provide access to the contents of the can. Two different types of straw holes are shown in these diagrams. (Vertical wall and tunnel)
Figure 1B:
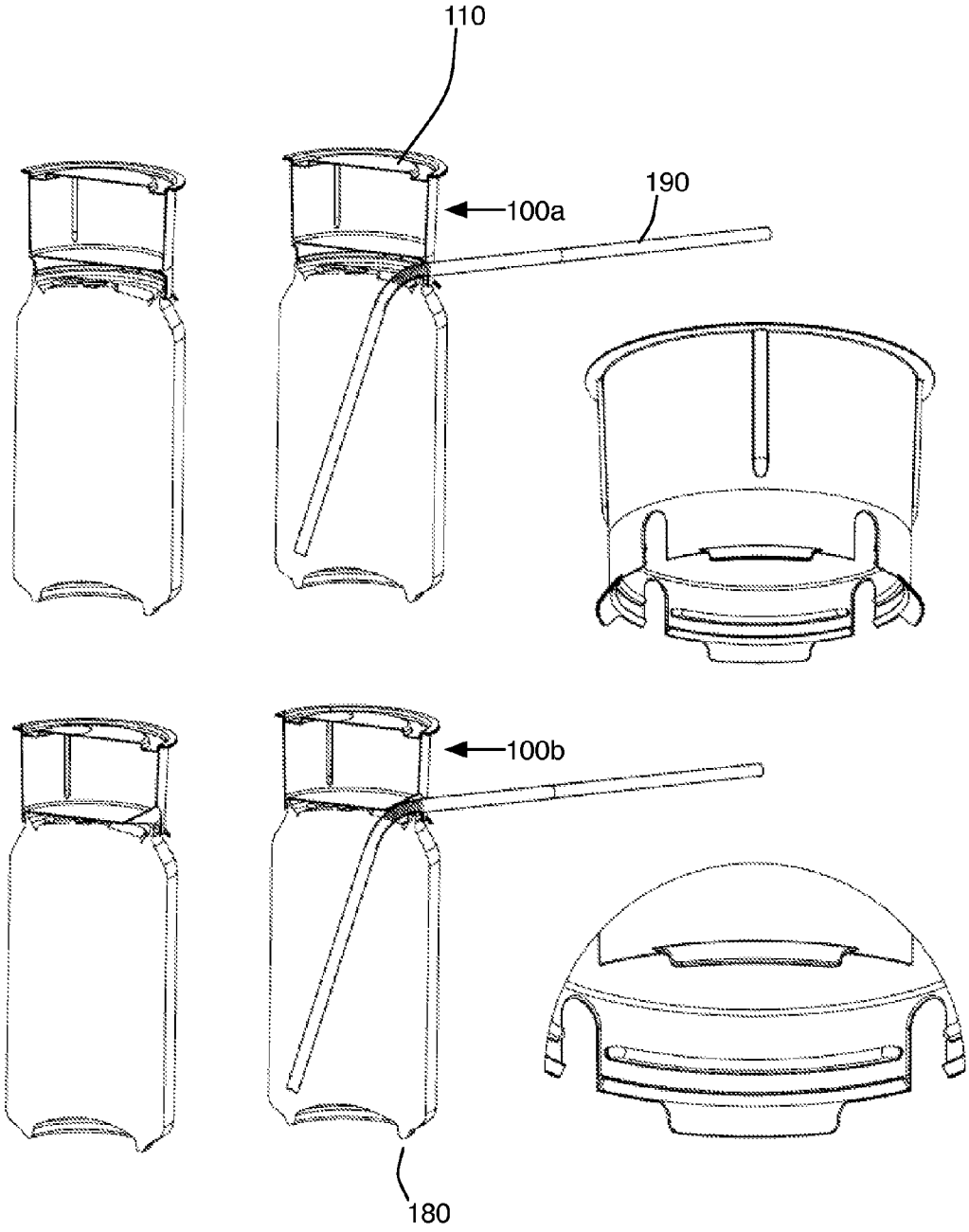
FIG. 1B illustrates cutaway views of the embodiments of FIG. 1A.

FIG. 1A illustrates a perspective view of a first embodiment of top mounting can container 100*a* shown in the upper right portion of the figure and rotated to show the volume within the container. Container 100*a* is also shown coupled with a can via can mount element 101*a* along with straw 190 and cover 110 in the upper middle portion of the figure. The same embodiment is shown with a packaged straw in the upper left portion of the figure. The straw hole in can mount element provides a path through which straw 190 travels under the bottom wall of can mount element 101*a*. Hence, can mount element 101*a* is generally provided with a wall that has a vertical dimension of at least the size of the desired straw type to be utilized. The figure also illustrates a perspective view of a second embodiment of top mounting can mount element 100*b* shown in the lower right portion of the figure and rotated to show the volume and straw tunnel within the container. Container 100*b* is also shown coupled with can 180 along with a straw and cover in the lower middle portion of the figure. As shown, a channel or tunnel for the straw is shown in the rotated view of can mount element 101*b* at approximately 5 o'clock in the rightmost lower figure. The tunnel enables straw 190 to travel into the side of the container and down into the can while providing a lower profile and less vertical height to the sidewall with respect to can mount element 101*a*. Any type of item including food may be placed within any embodiment of the top mounting can container. In these embodiments, the respective containers are momentarily removed and then reattached to the cans thus providing simultaneous access to the contents of the can. FIG. 1B illustrates cutaway views of the embodiments of FIG. 1A and in addition an enlarged view of can mount element 101*a* along with a close-up view in the lower right portion of the figure of the stop ridge shown in between two holes in the lower wall portion of can mount element 101*a*. Any type of stop element or ridge may optionally be utilized in embodiments of the invention including a ridge or ridges that travel the entire circumference of the can mount element or less than the entire circumference in any pattern or duty cycle.

Figure 2A:
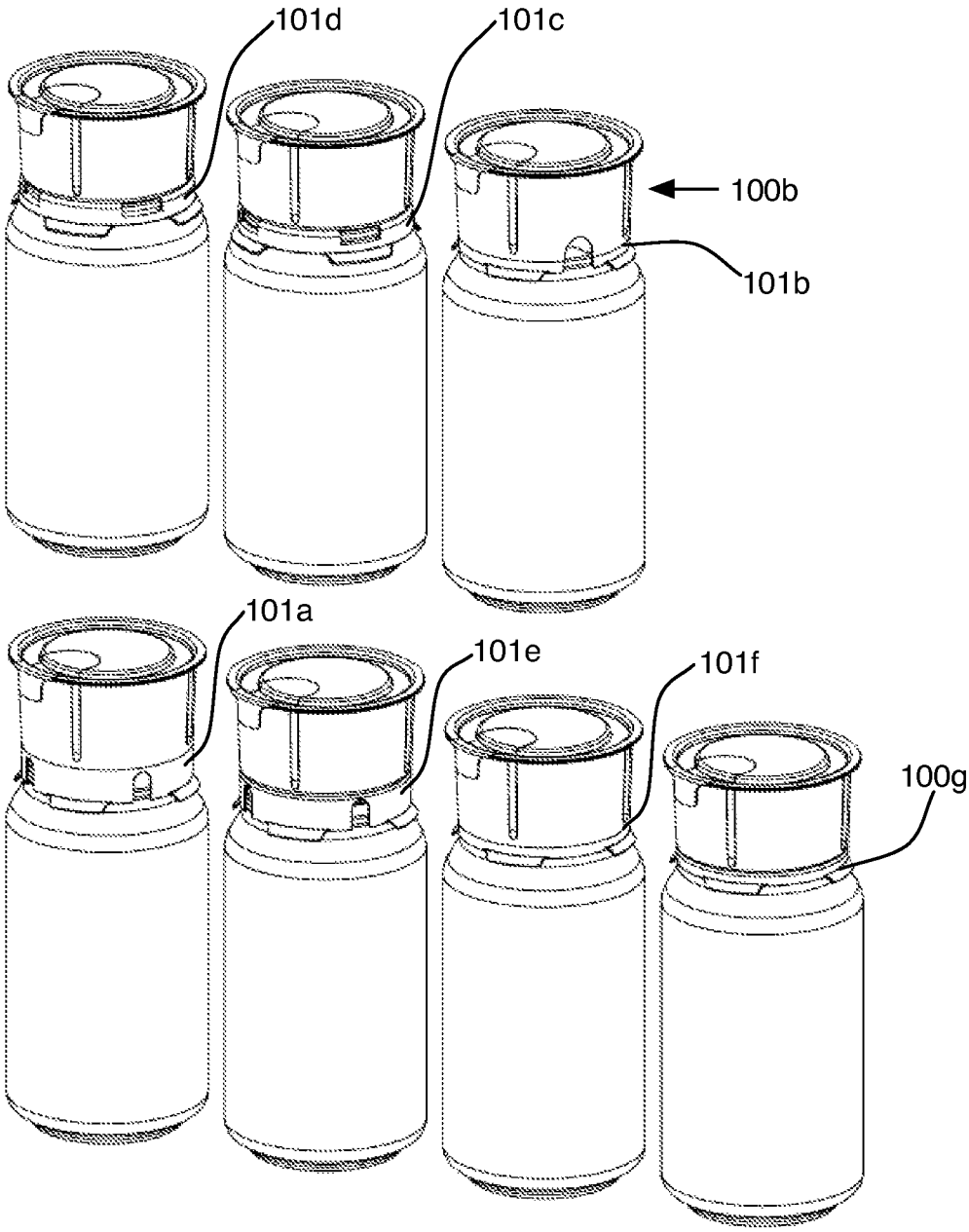
FIG. 2A illustrates a perspective view of various embodiments of the top mounting can container having one-part or two-part construction, and different can mount elements as required per application.
Figure 2B:
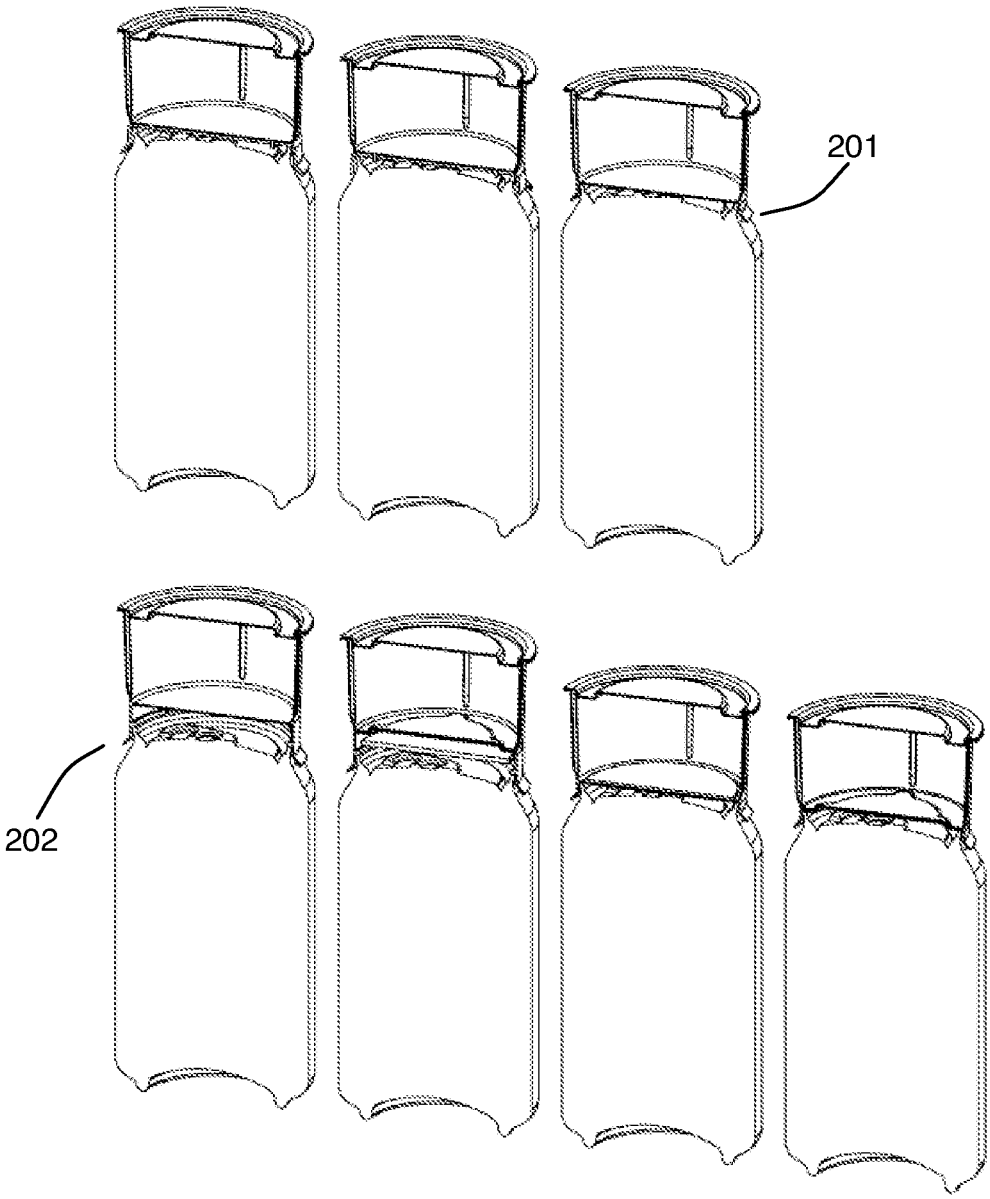
FIG. 2B illustrates a cutaway view of various embodiments of the top mounting can container having one-part or two-part construction, and different can mount elements as required per application. Also shown is low and high vertical offsets of the containers in various embodiments.

FIG. 2A illustrates a perspective view of various embodiments of the top mounting can container having different can mount elements. The upper row of embodiments shows can mount element 10 lb that does not have any injection mold release holes for inwardly projecting flange clip elements and which may mount on the can for example with hook style internally projecting flanges that engage the rolled rim of the can. Any other manner of coupling the container to a can is in keeping with the spirit of the invention. Can mount element 101*c* shows can alignment and receiving tabs which have been strategically located directly below the injection mold release holes to add strength to the right and left bottom corner areas of the release holes where the plastic is thin, weak, and prone to failure and/or tearing. A new and improved version of the invention is created by locating the can alignment, receiving and release tabs directly below the mold release holes and flange clip elements, due to the fact a direct correlation is created between lifting the release tabs and lifting and releasing the flange clip elements. Effectively, both elements are linked together and as such each affects the operation of the other. Although can alignment and receiving tabs are useful, they may interfere with the stacking of containers as part of the manufacturing process. Thus, if desired for production, the alignment and receiving tabs may be omitted from the construction of the container depending on the requirements of the particular implementation. If receiving tabs are omitted, a sufficient small slanted receiving edge may be utilized to allow the container to couple with the can. Additionally, if desired for production, the container may have a small ridge that is stepped outward in the vertical sidewall near the top edge of the container. This ridge provides a stand-off elevation of the container from the surface of the production line table. The standoff provides space for machinery to easily grip and extract the container from the production table for example. The new location of the can alignment receiving and release tabs is important in relation to the embodiment shown in the upper left, namely can mount element 101*d*, which for example may be an implementation of the device found in U.S. Pat. No. 7,588,275 to Borg, (see also FIG. 4). Can mount element 101*b* may be injection molded as a one-piece construction which is integrated with container 100*b*, while can mount element 101*c* and 101*d* may be part of a two piece construction where a bottom clip system is attached through various methods to the upper container. The combination of a can mount element and a container may be achieved via adhesive layers, hot melt glues, hook and loop fasteners with adhesive backing, heat bonding of compatible materials, a clip or locking system or in any other manner. Bottom portion embodiments 101*e* and 100*g* may also be combined with a container for two-part construction. Embodiments 101*a* and 101*f* may be injection molded as a one piece construction, combining the container and can mount element. FIG. 2B illustrates a cutaway view of various embodiments of the top mounting can container having different can mount elements and also showing the low and high vertical offset of the containers in the various embodiments.

Figure 3A:
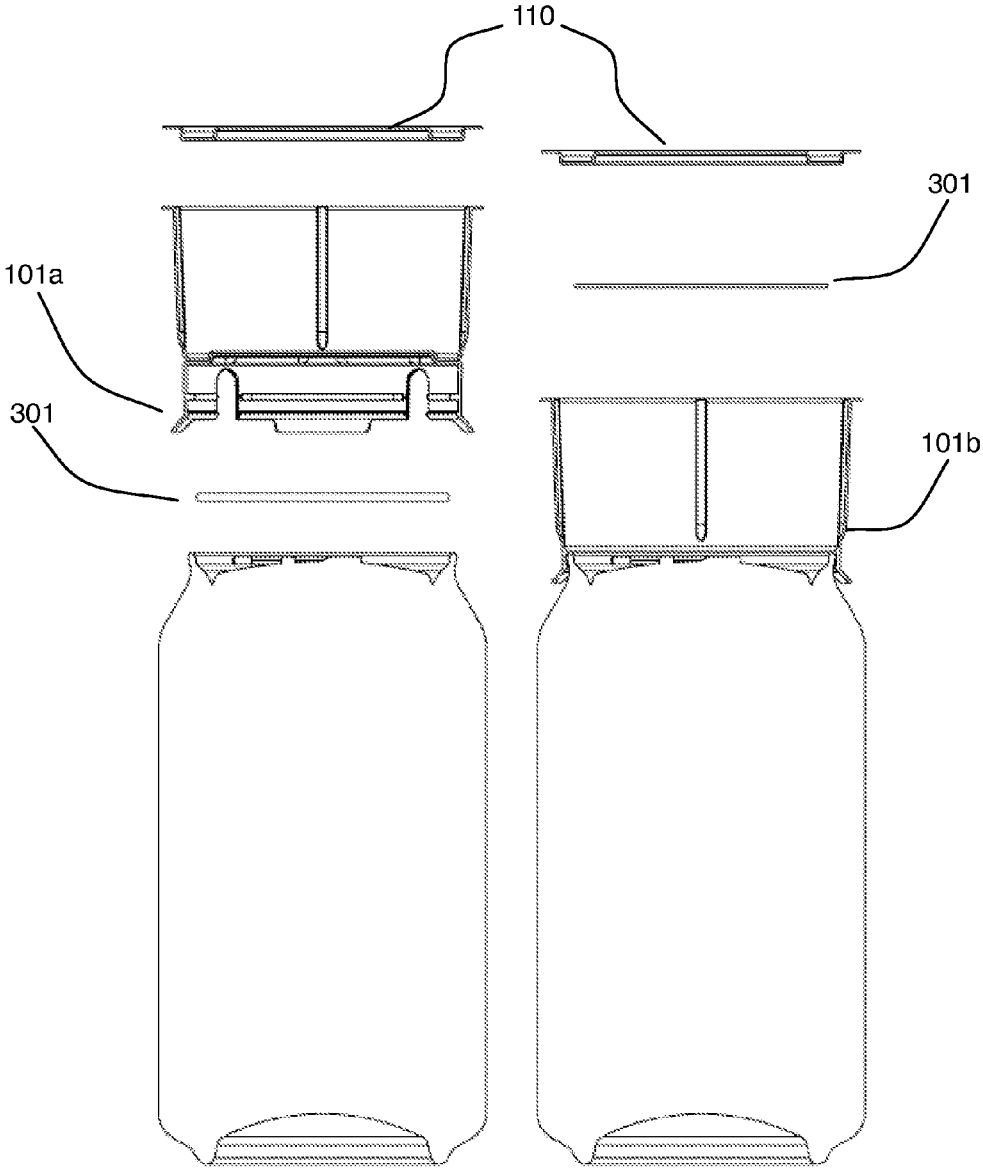
FIG. 3A illustrates a side view of various embodiments of the top mounting can container that include a promotional item located in different places.
Figure 3B:
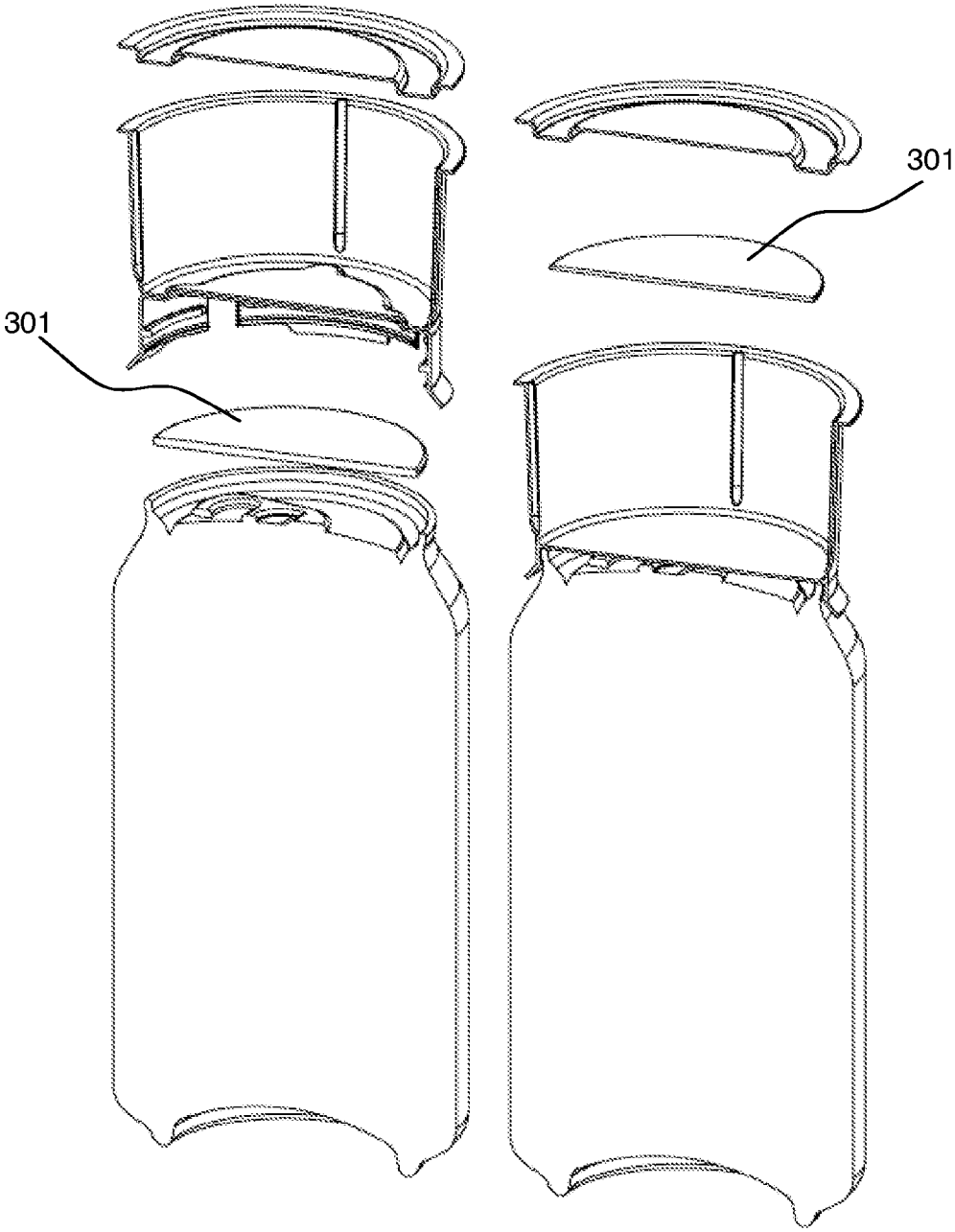
FIG. 3B illustrates a cutaway view of various embodiments of the top mounting can container that include a promotional item located in different places.

FIG. 3A illustrates a side view of various embodiments of the top mounting can container that include promotional item 301 located in different places. The left figure shows promotional item 301, for example a cardboard disc, coupon, advertisement, or any other item situated under can mount element 101*a*. Can mount element 101*b* shown on the right side of the figure may store promotional item 301 on the underside of cover 110, at the bottom inside surface of the container or anywhere else in the container or if thin enough, between the bottom of can mount element 101*b* and the can. FIG. 3B illustrates a cutaway view of various embodiments of the top mounting can container that include a promotional item located in different places.

Figure 4A:
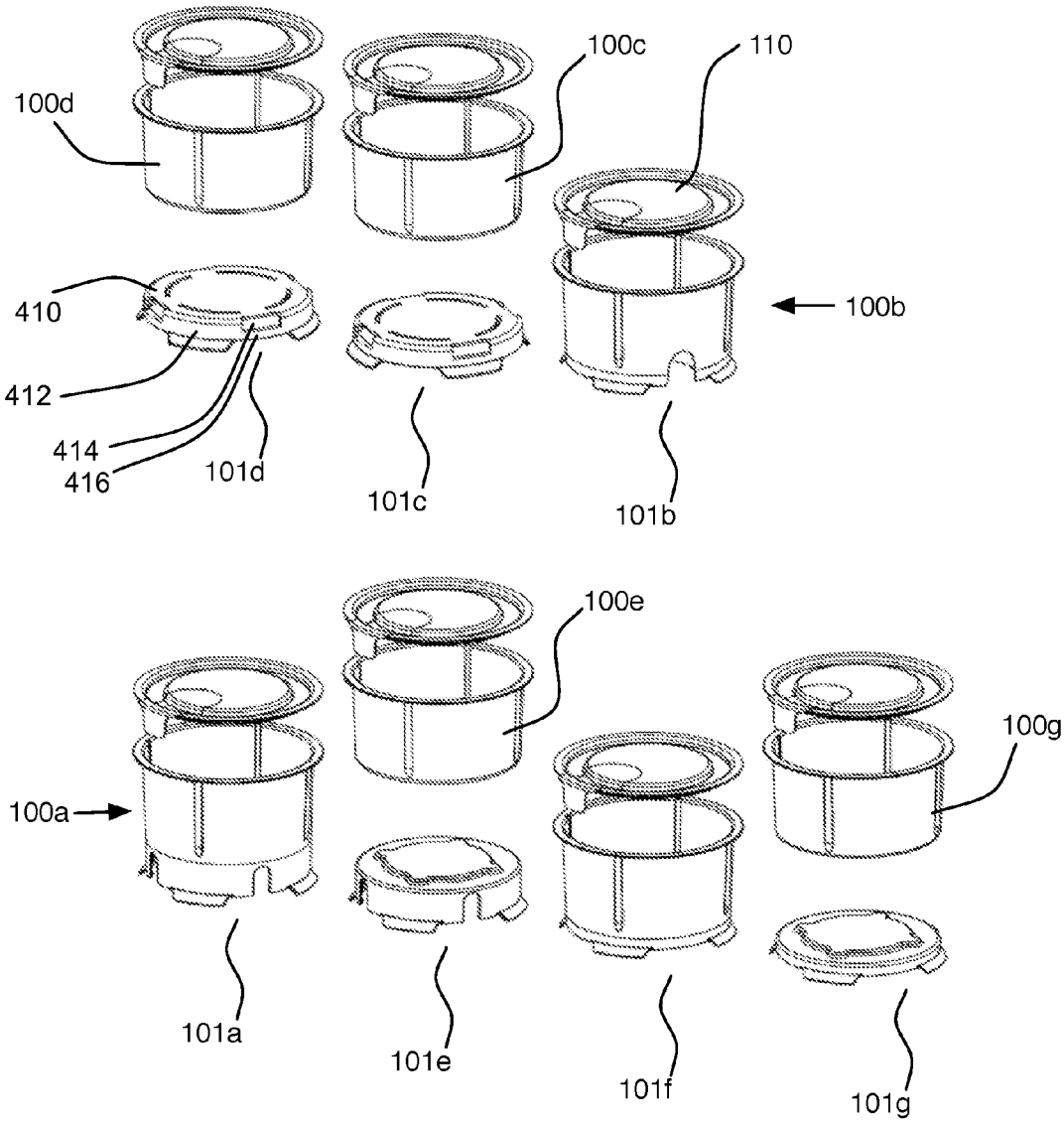
Figure 4B:
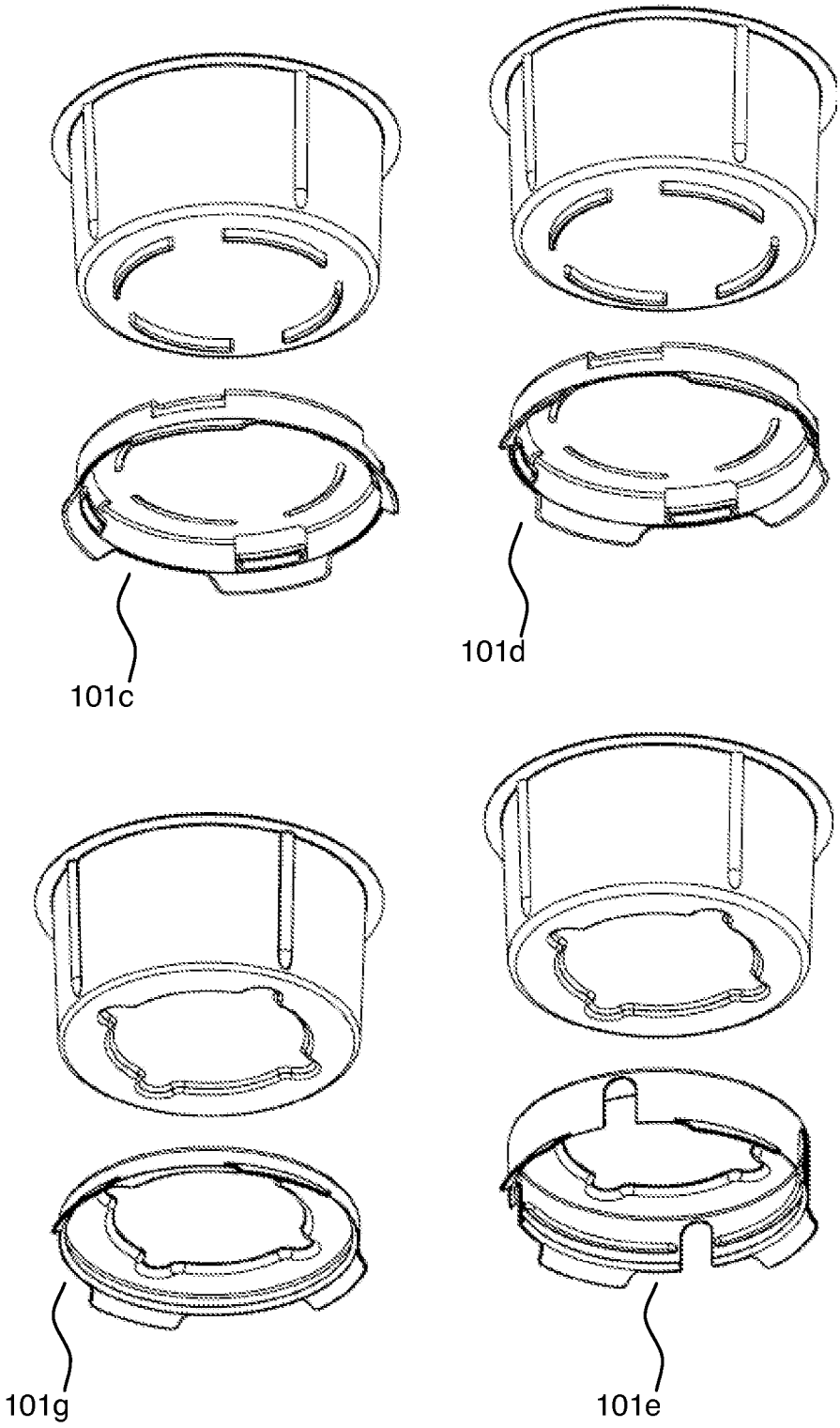
FIG. 4B shows bottom perspective view of the two part construction components.

FIG. 4A illustrates a perspective exploded view of various embodiments of the invention having one-part or two-part construction. See also FIG. 2A. As shown, two part construction may be utilized to combine a can mount element with a container, i.e., as per can mount element 101*d* and container 100*d*, can mount element 101*c* and container 100*c*, can mount element 101*e* and container 100*e* and can mount element 101*g* and container 100*g* respectively. Male to female coupling may be utilized to align the top container with the lower can mount element. See also FIG. 4B that shows a lower view of the two parts respectively. As shown, the top and bottom elements align at 90 degree increments. Patterns that allow one to four orientations are shown, however a non-patterned, or circular configuration that allows full rotational alignment, or patterns that allow any number or rotational orientations may be utilized to attach the top container to the lower can mount element. Alternatively, one shot injection mold versions of the container with integrated can mount element can be seen in the remaining embodiments having can mount elements 101*a*, 101*b* and 101*f*. Embodiment 101*d* may be an embodiment as taught in U.S. Pat. No. 7,588,275 to Borg, namely with the following elements: a substantially planar ring 410 with a plurality of downwardly projecting flanges 412 with arcuate gaps 414 between adjacent flanges, each of said arcuate gaps having a top side and a bottom side, each of said gaps being bordered on its top side by said planar ring 410 and on its bottom side by an arcuate segment 416 connecting adjacent flanges, said arcuate segment having an inwardly extending arcuate lip substantially parallel to said planar ring. Adding a container to the top of the device of Borg '275 enables functionality unknown in the art. Embodiment 101*c* is a new and improved version of Borg 101*d* where weak areas prone to failure have been strengthened and relocated release tabs effectively release the rim clip elements.

Figure 5:
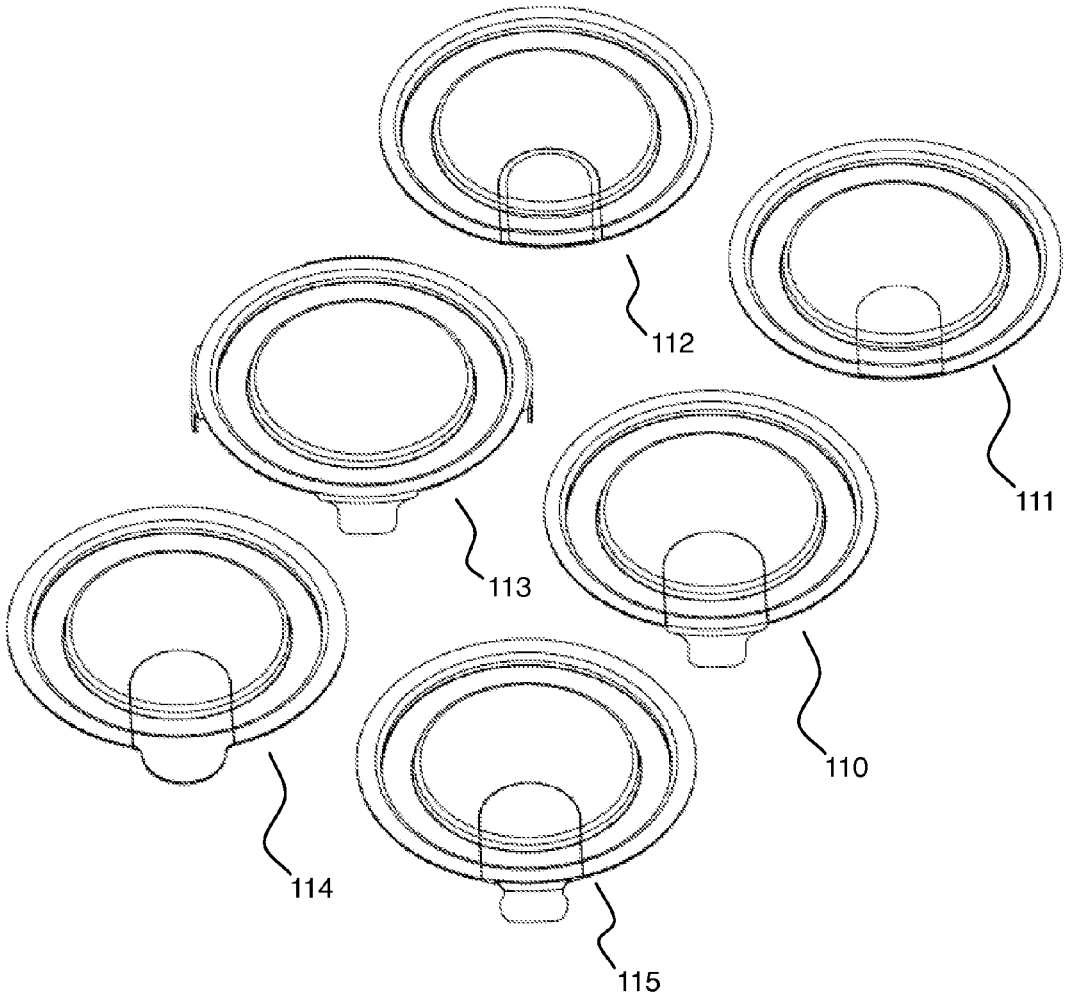
FIG. 5 illustrates a perspective view of various embodiments of the lid and tab.

FIG. 5 illustrates a perspective view of various embodiments of the lid. As shown cover 113 may be completely removed via any of the tabs for example cover 113 shows tabs bent downward to avoid intersecting cans packaged tightly together. Cover 112 may include a tab that is a separate piece of plastic that is heat sealed on the outside edge of the cover with a score line and which allows for the portion of the cover up to the score line to be removed via the tab by lifting the inside portion of the tab closest to the center of the cover. The tab relating to cover 112 also avoids intersecting cans packaged tightly together. Cover 111 may include a separate tab that is heat sealed on the outside edge of the cover and which allows for the entire cover to be removed via the tab by lifting the inside portion of the tab closest to the center of the cover. Covers 110, 115 and 114 enable removal of the cover or portion of the cover, depending upon the inclusion or exclusion of a score line, but differ in that the tabs are shown folded down, arched and pointing outward, and flat and pointing outward. The tabs of covers 114 and 115 may intercept cans in close proximity, but may be made of thin material such that the tabs flex or bend to accommodate intercepting cans. Any combination of tabs and optional holes via score lines may be utilized on one cover for example.

Figure 6:
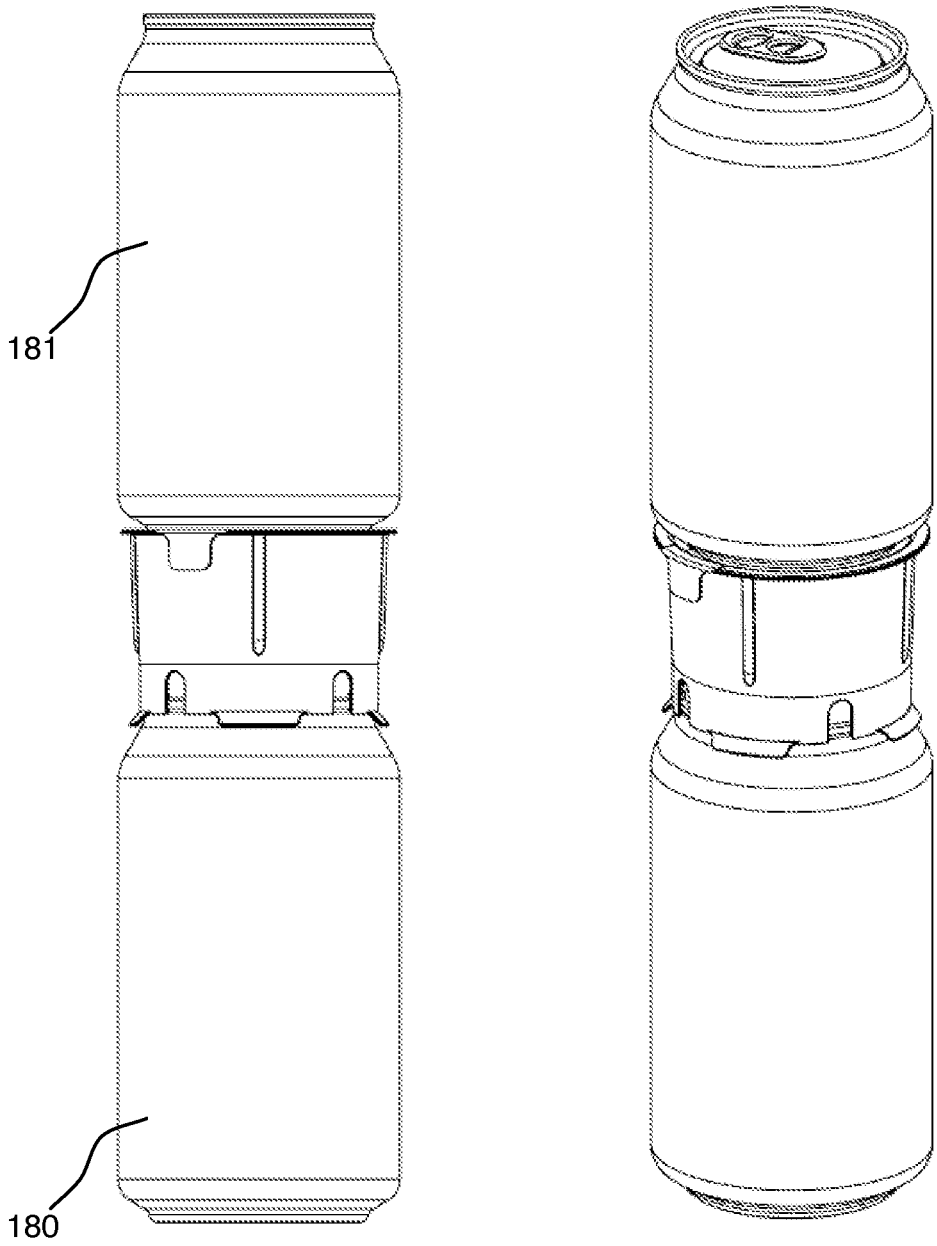
FIG. 6 illustrates the ability to stack cans that are coupled with an embodiment of the invention.

FIG. 6 illustrates the ability to stack cans that are coupled with an embodiment of the invention. As shown, can 181 fits on top of the container that is coupled with can 180. Any profile shape can be implemented as part of the design of the top cover, including one having an indented circular area that fits the bottom of a can as shown.

FIG. 7A illustrates a bottom view of a circular embodiment of can mount element 108*a* with two engagement portions on the left and right of the embodiment that engage the rolled rim of a can as per the non-permanent and semi-permanent mounting embodiments of the engagement portion of the can mount element shown in side view in FIG. 7C. FIG. 7B shows a bottom view of an elliptical embodiment of can mount element 108*b*, wherein pressing the top and bottom of the embodiment as shown in the figure disengages the engagement portions of the can mount element by increasing their diameter from left to right in the figure. The non-permanent embodiment of engagement portion 107*a* is shown as a slight indentation 177*a*, while semi-permanent engagement portion 107*b* shows a deeper indentation 177*b* for more secure mounting. Any other shapes may be utilized in keeping with the spirit of the invention so long as the structure utilized couples the container to the can in the desired manner.

While the invention herein disclosed has been described by means of specific embodiments and applications thereof, numerous modifications and variations could be made thereto by those skilled in the art without departing from the scope of the invention set forth in the claims.

What is claimed is:

1. A top mounting can container comprising:

at least one container configured to store a first solid or a liquid separate from a second solid or liquid stored in a can wherein said can comprises an opening area situated near a top portion of said can;

a can mount element comprising a first coupling element configured to couple said at least one container to said top portion of said can;

a second coupling element configured to couple said at least one container to said can mount element;

wherein said at least one container comprises a substantially flat bottom and wherein said can mount element comprises a hole on a side portion of said can mount element entirely beneath said substantially flat bottom of said at least one container;

wherein said can mount element is configured to enable access of said first liquid or solid in said can through said hole at a height that is entirely no higher than said substantially flat bottom of said at least one container;

wherein a bottommost portion of said hole in said can mount element that lies above said can when said can mount element is coupled with said can also lies above said first coupling element and wherein a topmost portion of said hole lies beneath said second coupling element; and, said at least one container configured to enable access of said first solid or liquid and said second solid or liquid after said can is opened and after said can mount element is coupled to said can.

2. The top mounting can container of claim 1, wherein said can mount element further comprises a substantially planar ring with a plurality of downwardly projecting flanges with arcuate gaps between adjacent flanges, each of said arcuate gaps having a top side and a bottom side, each of said gaps being bordered on its top side by said planar ring and on its bottom side by an arcuate segment connecting adjacent flanges, said arcuate segment having an inwardly extending arcuate lip substantially parallel to said planar ring.

3. The top mounting can container of claim 1, wherein said can mount element further comprises a substantially planar ring with a plurality of downwardly projecting flanges with arcuate gaps over flanges, each of said arcuate gaps having a top side and a bottom side, each of said gaps being bordered on its top side by said planar ring and on its bottom side by a flange.

4. The top mounting can container of claim 1, further comprising a cover that couples with the top of said at least one container and wherein said cover comprises a tab as part of said cover or as a separate die-cut piece of plastic or foil and comprises score lines and wherein said cover further comprises a vertical ring shaped indentation to enable stacking of a can on top of said container or wherein said cover further comprises foil having one or more layers.

5. The top mounting can container of claim 1, wherein said can mount element is coupled with at least one other can mount element to form a coupled group of multiple cans and wherein said can mount element comprises a cover having bent tabs.

6. The top mounting can container of claim 1, wherein said can mount element further comprises receiving and release tabs to engage and disengage said can mount element to and from said can respectively and wherein said receiving and release tabs are coupled to a circular or an elliptical bottom portion of said can mount element.

7. The top mounting can container of claim 1, further comprising:

a paper or thermal liner configured to reside within said container.

8. The top mounting can container of claim 1, further comprising a stop ridge element on an inside portion of said can mount element that limits a height at which said can mount element couples over said can wherein said height is greater than the diameter of a straw or a height of a promotional item whichever is greater.

9. The top mounting can container of claim 1, wherein said at least one container comprises a thermochromic plastic configured to change color based on a temperature of said first solid or liquid.

10. The top mounting can container of claim 1, wherein said at least one container comprises graphic symbols or lettering or both graphic symbols and lettering of visual or tactile form or logos, advertisements, puzzles, promotions, trivia or information.

11. The top mounting can container of claim 1, further comprising a lid configured to cover said at least one container to reseal said at least one container after said at least one container is opened.

12. The top mounting can container of claim 1, further comprising a promotional item wherein said promotional item is configured to fit between said can mount element and said can.

13. The top mounting can container of claim 1, wherein said at least one container and said can mount element comprise male and female alignment elements or circular elements that comprise said second coupling element that enable any rotational alignment wherein said can mount element may be permanently or non-permanently coupled said at least one container and can mount element together.

14. The top mounting can container of claim 1, wherein said first liquid or solid comprises one or more cookies, chocolates, chips, crackers, nuts, popcorn, candies, ice cream, frozen yogurt, fruit pieces, burgers, french fries, or sandwiches and wherein said second liquid or solid comprises lemonade, milk, water, soda, coffee, alcoholic beverage or beer.

15. The top mounting can container of claim 1, wherein said at least one container comprises strength ribs in at least one wall of said at least one container to increase strength or wherein said at least one container comprises a thermal liner or paper liner or wherein said at least one container comprises tapered walls to enable stacking.

16. A top mounting can container comprising:

at least one container configured to store a first solid or a liquid separate from a second solid or liquid stored in a can wherein said can comprises an opening area that situated near a top portion of said can;

a can mount element configured to couple said at least one container to said top portion of said can wherein said can mount comprises a substantially planar ring with a plurality of downwardly projecting flanges with arcuate gaps between adjacent flanges, each of said arcuate gaps having a top side and a bottom side, each of said gaps being bordered on its top side by said planar ring and on its bottom side by an arcuate segment connecting adjacent flanges, said arcuate segment having an inwardly extending arcuate lip substantially parallel to said planar ring; and, wherein said at least one container comprises a substantially flat bottom and wherein said can mount element comprises a hole on a side portion of said can mount element entirely beneath said container wherein said can mount element is configured to enable access of said first liquid or solid in said can at a height that is entirely no higher than said substantially flat bottom of said at least one container.

17. The top mounting can container of claim 16, wherein said at least one container is configured to enable access of said first solid or liquid and said second solid or liquid in said can after said can is opened and after said can mount element is coupled to said can.

18. The top mounting can container of claim 16, wherein said at least one container comprises a thermochromic plastic configured to change color based on a temperature of said first solid or liquid.

19. A top mounting can container comprising:

at least one container configured to store a first solid or a liquid separate from a second solid or liquid stored in a can wherein said can comprises an opening area that situated near a top portion of said can;

a can mount element configured to couple said at least one container to said top portion of said can wherein said can mount comprises a substantially planar ring with a plurality of downwardly projecting flanges with arcuate gaps between adjacent flanges, each of said arcuate gaps having a top side and a bottom side, each of said gaps being bordered on its top side by said planar ring and on its bottom side by an arcuate segment connecting adjacent flanges, said arcuate segment having an inwardly extending arcuate lip substantially parallel to said planar ring;

a cover that couples with the top of said at least one container;

wherein said at least one container is configured to enable access of said first solid or liquid and said second solid or liquid after said can is opened and after said can mount element is coupled to said can;

wherein said at least one container comprises a substantially flat bottom and wherein said can mount element comprises a hole on a side portion of said can mount element entirely beneath said container wherein said can mount element is configured to enable access of said first liquid or solid in said can at a height that is entirely no higher than said substantially flat bottom of said at least one container; and, wherein said at least one container comprises a thermochromic plastic configured to change color based on a temperature of said first solid or liquid.

* * * * *